US005920745A

United States Patent [19]

Inoo

[11] Patent Number: 5,920,745

[45] Date of Patent: Jul. 6, 1999

[54] METHOD AND APPARATUS FOR MANAGING RECORDING SHEET JAMS

[75] Inventor: Masaaki Inoo, Yokohama, Japan

[73] Assignee: Canon Kabushiki Kaisha, Tokyo, Japan

[21] Appl. No.: 08/891,327

[22] Filed: Jul. 10, 1997

[30] Foreign Application Priority Data

Jul. 12, 1996 [JP] Japan ..... 8-182936

[51] Int. Cl.[6] ..... G03G 15/00

[52] U.S. Cl. ..... 399/21; 399/43

[58] Field of Search ..... 399/21, 43, 18–20

[56] References Cited

U.S. PATENT DOCUMENTS 4,521,102 6/1985 Motomura et al. ..... 399/19
4,739,366 4/1988 Braswell et al. ..... 399/10
5,012,281 4/1991 Kusumoto et al. ..... 399/21
5,034,771 7/1991 Makita ..... 399/21

FOREIGN PATENT DOCUMENTS 5-270622 10/1993 Japan .

*Primary Examiner*—Robert Beatty
*Attorney, Agent, or Firm*—Fitzpatrick, Cella, Harper & Scinto

[57] ABSTRACT

A method for managing recording sheet jams in an image-forming apparatus includes detecting a current jam in the image-forming apparatus, storing a number of image formation operations performed by the image-forming apparatus when the current jam is detected, and a first determining step for determining whether the current jam is a true jam or a false jam based on a number of image formation operations obtained for a previous jam and a number of image formation operations for the current jam.

24 Claims, 7 Drawing Sheets

TB

| JAM CODE | COUNTER NUMBER | TIME AND DATE |
|---|---|---|
| J004 | 10002 | 1993.10.1 |
| J003 | 10010 | 1993.10.2 |
| J012 | 10100 | 1993.10.3 |
| J103 | 10300 | 1993.10.4 |

METHOD AND APPARATUS FOR MANAGING RECORDING SHEET JAMS

BACKGROUND OF THE INVENTION

1. Field of the Invention

The present invention relates generally to management of recording-sheet jams occurring in an image-forming apparatus.

2. Related Background Art

In conventional image-forming apparatuses, it is difficult to determine accurately the number of recording sheet jams due, in part, to the way in which such jams are counted. More specifically, in conventional apparatuses, each time a jam occurs, the apparatus stops image formation and a counter is incremented. Thereafter, a user "fixes" the jam, generally by removing the jammed recording sheet, and hits a "START" operation button to continue image formation. At this point, the user will often find that the jam has not been properly cleared, and the apparatus will not continue operation as a result. However, even though the apparatus will not continue operation, since the "START" button was activated, the counter will again be incremented. Thus, in conventional apparatuses, oftentimes two (or more) jams will be counted when, in fact, only one jam has occurred which was not cleared properly.

Thus, there exists a need for an image forming system which determines whether a jam is a "true" jam (i.e., a jam which occurred during operation) or a "false" jam (i.e., a jam which has been recorded as a result of a failure to correct a previous jam), and which can count such jams relatively accurately.

SUMMARY OF THE INVENTION

The present invention addresses the foregoing need by providing a system, for use in an image-forming apparatus, which determines whether a recording sheet jam in the apparatus is a true jam or a false jam, and which alters the recording sheet jam count accordingly.

In the invention, a variety of methods can be used to determine whether a recording sheet jam is a true jam or a false jam. For example, in one aspect of the invention, a number of image formation operations which have been performed prior to a current jam is compared to a number of image forming operations which had been performed prior to a previous jam. If the compared numbers are the same (i.e., no image formation operations were performed between the current and previous jams), the system concludes that the current jam is a false jam, and does not count the current jam. Conversely, if the numbers are different (i.e., image formation operations have been performed between the two jams), the system concludes that the current jam is a true jam.

Thus, according to the foregoing aspect, the present invention is a system for managing recording sheet jams in an image-forming apparatus, which includes first counting means for counting a current number of image formation operations performed by the image-forming apparatus, and jam detection means for detecting a current jam in the image-forming apparatus. Storage means stores (1) the current number counted by the first counting means when the jam detection means detects the current jam, and (2) a previous number counted by the first counting means for a previous jam. First determining means determines whether the current jam is a true jam or a false jam based on the current number and the previous number.

According to another aspect, the present invention is a system for managing recording sheet jams in an image-forming apparatus, which includes jam detection means for detecting a current jam in the image-forming apparatus, and acquiring means for acquiring a number of image formation operations performed by the image-forming apparatus when the current jam is detected by the jam detection means. Determination means determines whether the current jam is a true jam or a false jam based on the number of image formation operations acquired by the acquiring means and a number of image formation operations previously acquired by the acquiring means for a previous jam.

As noted above, by using the number of image formation operations performed prior to the current and previous jams, the foregoing aspect of the invention is able to determine whether the current jam is a true jam or a false jam more accurately than its conventional counterparts.

According to another aspect, the present invention is a system for managing recording sheet jams in an image-forming apparatus, which includes jam detection means for detecting a current jam in the image-forming apparatus, storage means for storing a time and a date at which the jam detection means detects the current jam, and first determining means for determining whether the current jam is a true jam or a false jam based on the time and the date stored in the storage means and a time and a date at which a previous jam occurred.

By comparing the time and the date of the current jam to those of the previous jam, the foregoing aspect of the invention is able to determine the time difference between the two jams. This information is then used to determine whether the current jam is a true jam or a false jam. For example, according to one embodiment of the invention, if the time difference is less than a predetermined value, the invention concludes that the current jam occurred too close to the previous jam to be a true jam and therefore concludes that the current jam is a false jam. Conversely, in this embodiment, if the time difference is greater than the predetermined value, the invention concludes that the current jam is a true jam.

According to still another aspect, the present invention is a system for managing recording sheet jams in an image-forming apparatus, which includes jam detection means for detecting a current jam in the image-forming apparatus, acquiring means for acquiring a time and a date at which the current jam is detected by the jam detection means, and determination means for determining whether the current jam is a true jam or a false jam based on the time and date acquired by the acquiring means and a time and a date acquired when a previous jam was detected.

The features and advantages of the foregoing aspect of the invention have been described above and, therefore, have not been repeated here for the sake of brevity.

This brief summary has been provided so that the nature of the invention may be understood quickly. A more complete understanding of the invention can be obtained by reference to the following detailed description of the preferred embodiments thereof in connection with the attached drawings.

DESCRIPTION OF THE PREFERRED EMBODIMENTS

[First Embodiment]

Figure 1:
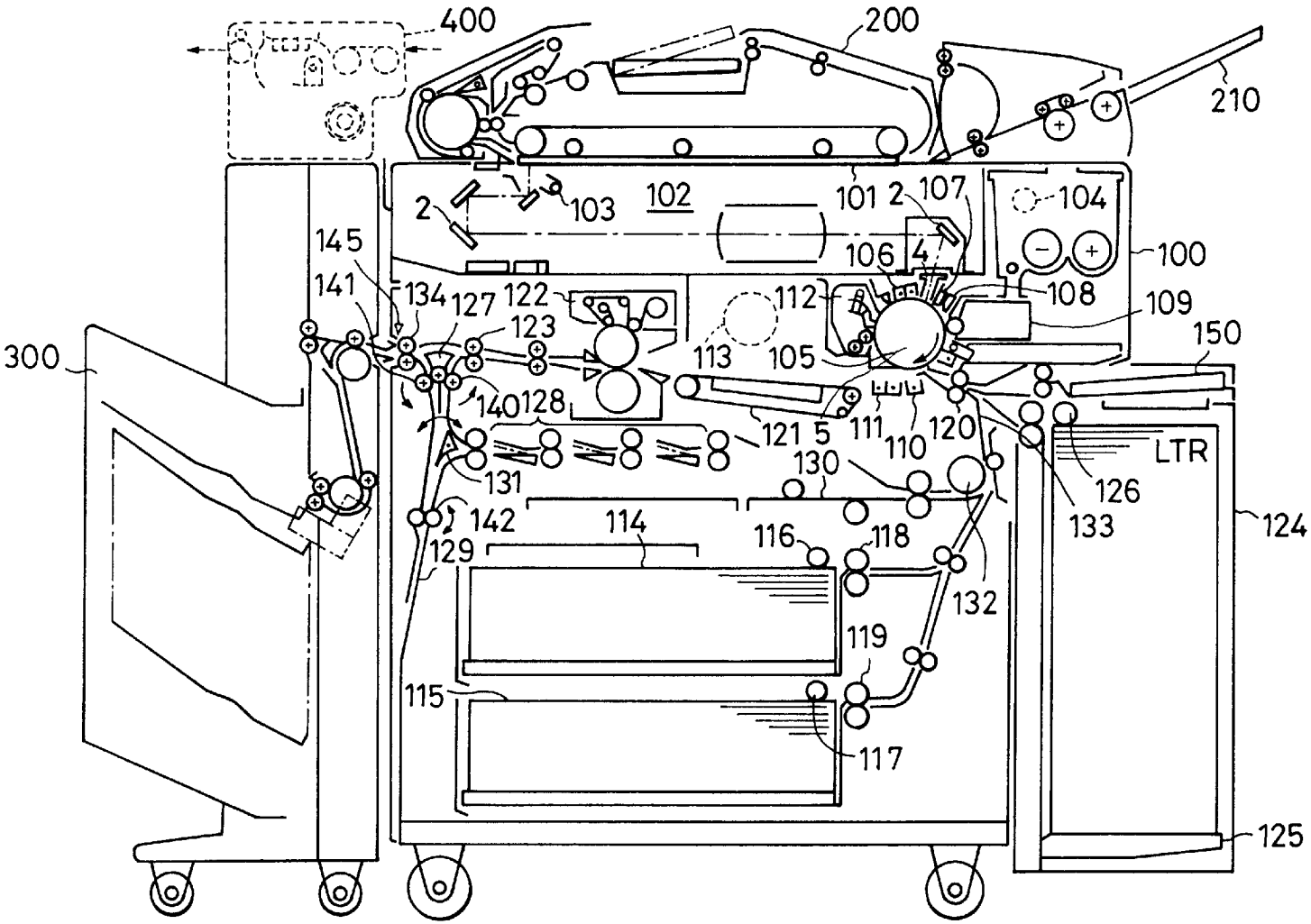
FIG. 1 is a sectional view illustrating a copying machine used in a copying system according to an embodiment of the present invention.

FIG. 1 is a sectional view illustrating a copying machine applicable to a copying system according to a first embodiment of the present invention.

Referring to FIG. 1, the copying machine includes a copying machine body 100, a repeating-type automatic document feeder (RDF) 200, a sorter 300, and an automatic computer form feeder (CFF) 400. The RDF 200, the sorter 300 and the CFF 400 can be combined within the copying machine body 100 in a variety of ways in accordance with the copying system of the present invention.

Copying machine body 100 includes a document table glass 101, onto which documents are placed, an optical system 102, which serves as an image reading means, a document illumination lamp (exposure lamp) 103, scanning mirrors 2, a lens 4, a motor 104, and a photosensitive drum 105. In operation, a document on table glass 101 is illuminated by the exposure lamp 103 while being scanned by the motor 104. According to this arrangement, light reflected from the document is transmitted to the photosensitive drum 105 via the scanning mirrors 2 and the lens 4 so as to form an electrostatic image on the drum 105.

Disposed around the photosensitive drum 105 are a high-pressure unit 106, a blank exposure unit 107, a potential sensor 108, a developer unit 109, a transfer charger 110, a separating charger 111, and a cleaner 112, all of which are required to form an image. These components, in combination with drum 105, comprise an image forming section.

Photosensitive drum 105 is rotated by a main motor 113 in the direction indicated by arrow 5 shown in FIG. 1, and is corona-charged by the high-pressure unit 106. When the light reflected from the document on table glass 101 is directed to the drum 105 by the optical system 102, an electrostatic latent image is formed on the drum 105. The latent image is then developed by the developer unit 109 into a toner image.

A transfer sheet, onto which the toner image is to be transferred, is supplied from an upper cassette 114 or a lower cassette 115 to the machine body 100 by paper-feeding rollers 118 or 119 via a pick-up roller 116 or 117. Timing is provided by register rollers 120 so that a forward end of the toner image matches the forward end of the transfer sheet. The transfer sheet is then fed to the photosensitive drum 105, and the toner image formed on the drum 105 is transferred to the transfer sheet by the transfer charger 110.

After the transfer operation, the transfer sheet is separated from the photosensitive drum 105 by the separating charger 111 and is guided to a fixing unit 122 by a conveyer belt 121. There, the toner image is fixed on the transfer sheet by pressing and heating the image on the sheet. Subsequently, the sheet is discharged to the exterior of the machine body 100 by discharging rollers 123. The surface of the photosensitive drum 105 is then cleaned by the cleaner 112.

Included on machine body 100 is deck 124, into which approximately 4000 transfer sheets can be loaded. A lifter 125 provided for the deck 124 is lifted in accordance with the number of sheets loaded in deck 124 so as to ensure positive abutment of a sheet against a feeding roller 126.

A discharging flapper 127 switches between a double-sided or multiple recording path and a discharging path (sorter 300) so as to guide a transfer sheet from the discharging rollers 123. Reference numeral 128 indicates a lower feeding path in which the transfer sheet fed from the discharging rollers 123 is reversed and guided to a refeeding tray 130 via a reversing path 129.

A multiple flapper 131 switches between the double-sided recording path and the multiple recording path. In the configuration shown in FIG. 1, flapper 131 is tilted to the left so as to guide a transfer sheet to the lower feeding path 128 and not to the reversing path 129. A feeding roller 132 feeds the transfer sheet to the photosensitive drum 105 via path 133. Discharging rollers 134 are disposed in the vicinity of the discharging flapper 127 to discharge a transfer sheet switched to the discharging path by the flapper 127.

For performing double-sided recording (double-sided copying) or multiple recording (multiple copying), the discharging flapper 127 is lifted in the upward direction, as shown in FIG. 1, to accommodate the copied transfer sheet remaining upside down within the refeeding tray 130 via the reversing path 129 and the lower feeding path 128. Then, the multiple flapper 131 is tilted to the right as indicated by the arrow shown in FIG. 1 during a double-sided recording operation, and is tilted to the left during a multiple-recording operation. For the following reverse-side recording or multiple recording operation, transfer sheets accommodated in the refeeding tray 130 are guided one by one to the register rollers 120 by the feeding roller 132 through the path 133.

For reversing a transfer sheet and discharging it from the machine body 100, the discharging flapper 127 is lifted, and the multiple flapper 131 is tilted to the right as shown in FIG. 1, to feed the copied sheet to the reversing path 129. After the rear end of the sheet passes through a first roller 140, the sheet is fed to a second feeding roller 141 through reversing rollers 142 and is reversed by the discharging rollers 134 to be discharged to the exterior of the machine body 100. In FIG. 1, there are also shown a multiple manual feeder 150 and a presetting tray 210. A discharge sensor 145 is used for counting the number of copies.

Figure 2:
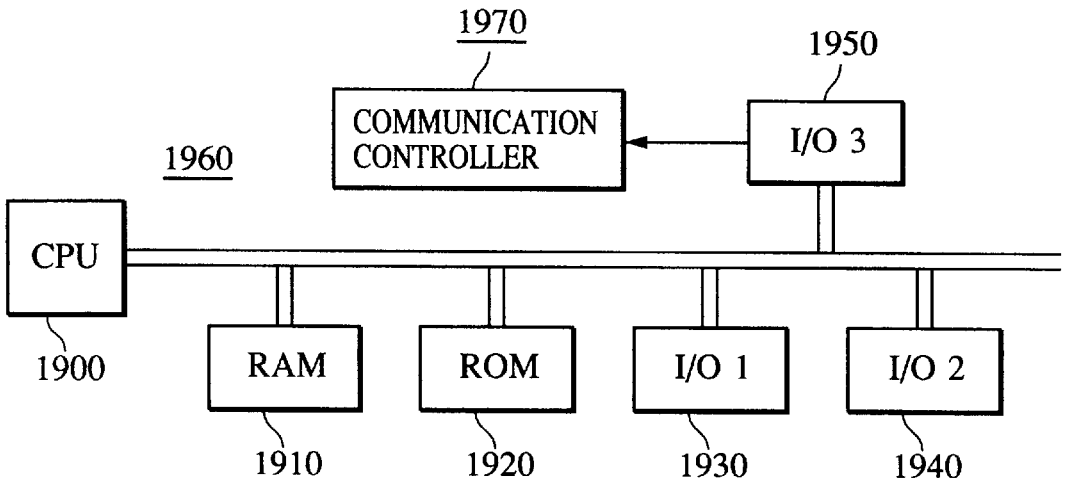
FIG. 2 is a block diagram illustrating the configuration of a control system used in the copying machine shown in FIG. 1.

FIG. 2 is a block diagram illustrating a control system used in the copying machine shown in FIG. 1. The system is constructed of a copying controller 1960 and a communication controller 1970.

In the copying controller 1960, a CPU 1900, which controls operation of the overall copying machine, controls respective elements of the copying machine based on a control program which is stored in a ROM 1920, and which is described in detail below. A RAM 1910 is used as a main memory area and a work memory area for the CPU 1900. An interface 1930 (I/O1) serves to control various motors, while an interface 1940 (I/O2) functions to read the status of various sensors. An interface 1950 (I/O3) is used as a serial interface to communicate with communication controller 1970.

Figure 3:
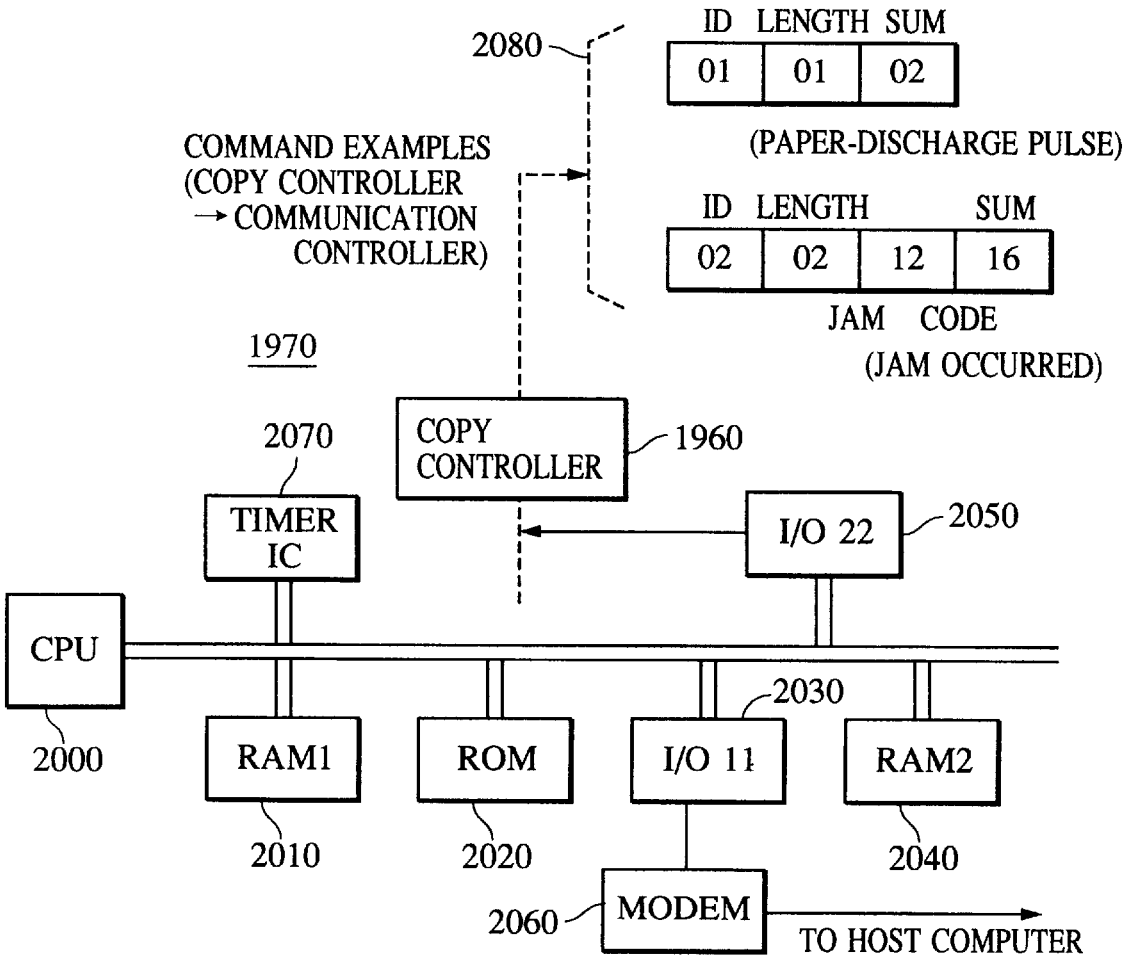
FIG. 3 is a block diagram illustrating the configuration of the communication controller shown in FIG. 2.

FIG. 3 is a block diagram illustrating the configuration of the communication controller 1970 shown in FIG. 2. The same elements as those shown in FIG. 2 are designated by like reference numerals.

A CPU 2000 controls the operation of the communication controller 1970. A first RAM (RAM1) 2010 is used as a work area for CPU 2000. A ROM 2020 stores a program which controls operation of the CPU 2000. A serial interface (I/O11) 2030 communicates with a modem 2060. A battery-backed second RAM (RAM2) 2040 stores jam information (e.g., the number of recording sheet jams, etc.) and various copy count numbers. A serial interface 2050 (I/O22) communicates with the copying controller 1960 via the above-described serial interface I/O3 1950. A timer IC 2070 controls timing for communication controller 1970.

Reference numeral 2080, shown in FIG. 3, designates communication commands which may be transmitted between the copying controller 1960 and the communication controller 1970. "ID" comprises data identifying the type of command; "length" comprises data length for the command; "sum" comprises data for detecting communication errors; and "jam code" comprises the type of jam (i.e., delayed jam or stationary jam). The respective examples of the communication commands shown in FIG. 3 indicate data transmitted from the copying controller 1960 to the communication controller 1970 when a count pulse (ID=01) during paper discharging and a jam (ID=02) are generated in copying controller 1960. In the communication controller 1970, count pulses (ID=01) generated during paper discharging are counted to detect the number of copies. When data concerning a jam (ID=02) is transmitted, the type of jam can be detected according to the jam code.

Figure 4:
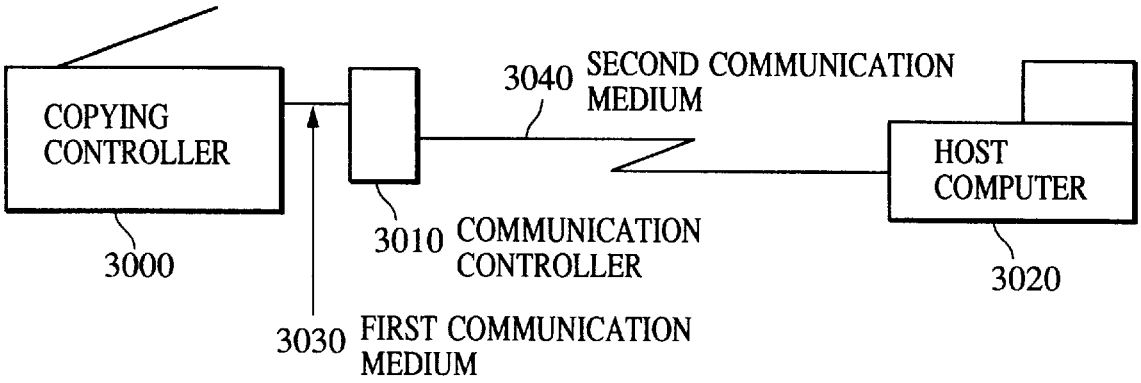
FIG. 4 is a schematic block diagram illustrating the communication system of the copying system according to the present invention.

FIG. 4 is a schematic block diagram which depicts a copying system according to the present invention. The system includes a copying controller 3000 for controlling copying of original documents, and a communication controller 3010 for controlling communications between the copying controller 3000 and a host computer 3020. The host computer 3020 has a memory in which various types of data sent from the copying controller 3000 are stored and managed. The system also has a first communication medium 3030 over which serial communications are transmitted, and a second communication medium 3040 which comprises a public or private line. When the number of jams in the copying machine reaches a predetermined value, the communication controller 3010 transmits jam management data to the host computer 3020 via second communication medium 3040. Alternatively, the controller 3010 may transmit data every time a jam occurs.

Figure 5:
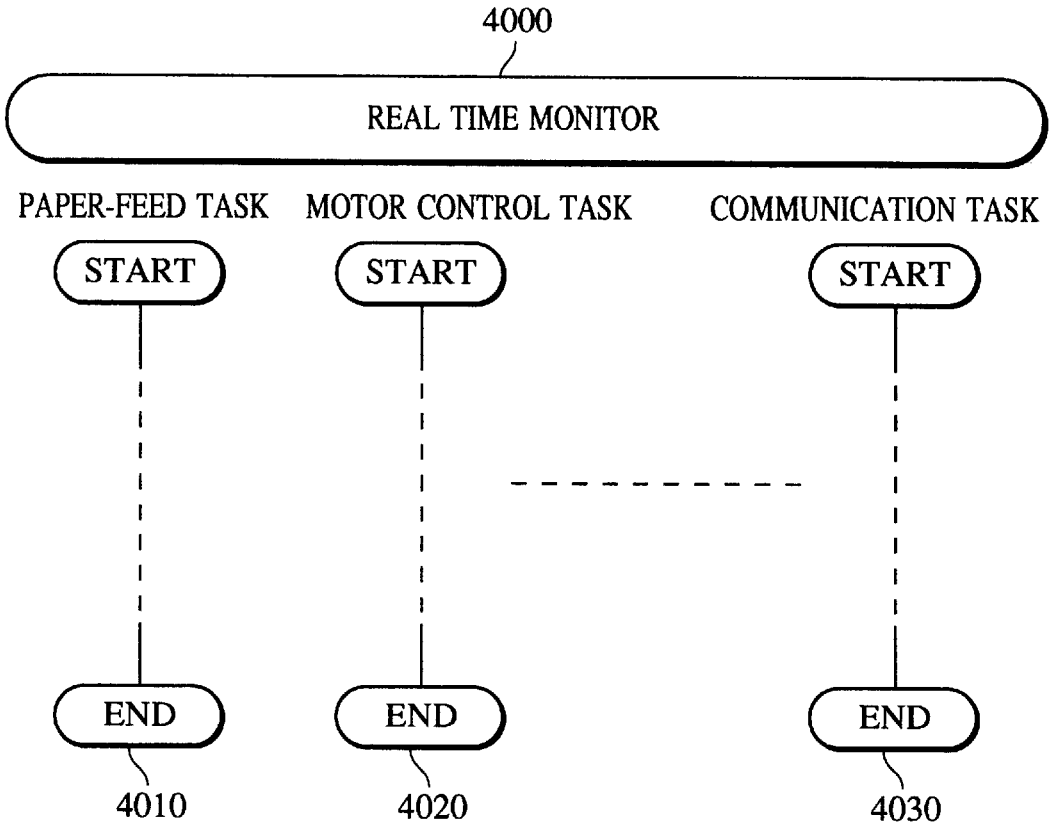
FIG. 5 is a schematic diagram of software used in the copying system shown in FIG. 4.

FIG. 5 is a schematic diagram illustrating software used in the copying system shown in FIG. 4. In the copying system, task processing is executed by the copying controller 3000. FIG. 5 shows that the software is divided into a plurality of tasks 4010 through 4030, each corresponding to one of a plurality of functions, which simultaneously perform allocated operations under control of a real time monitor 4000, also shown in FIG. 5. The major tasks include a paper-feeding task (task 4010), a motor control task (task 4020), and a communication task (4030), although other tasks may be included. The communication task 4030 also communicates with the communication controller 3010.

Figures 6, 8:
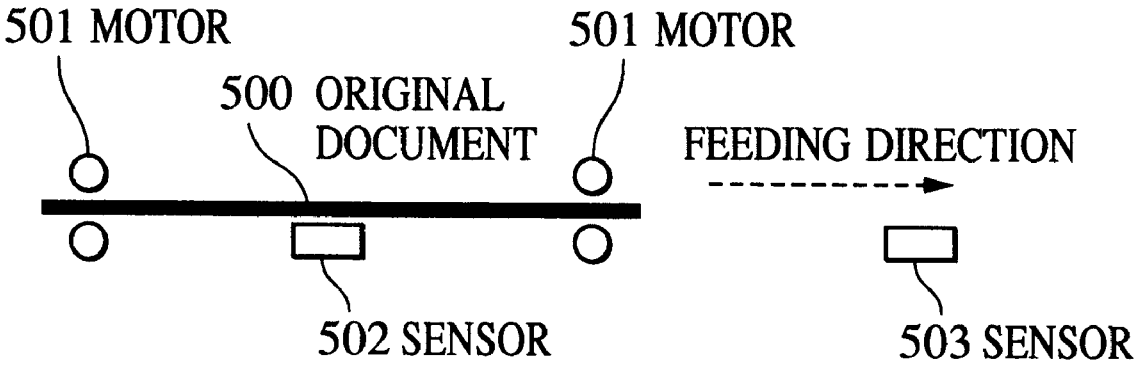
FIG. 6 is a schematic diagram illustrating the repeating-type automatic document feeder shown in FIG. 1.
FIG. 8 illustrates an example of a jam recording table stored in the RAM shown in FIG. 3.

FIG. 6 is a schematic diagram illustrating the recycle-type automatic document feeder (RDF) 200 shown in FIG. 1. In FIG. 6, an original document 500 is fed by the driving motors 501 in the direction of the arrow shown in FIG. 6. Sensors 502 and 503 detect whether the document 500 has passed therethrough and notify CPU 1900 accordingly.

Figure 7:
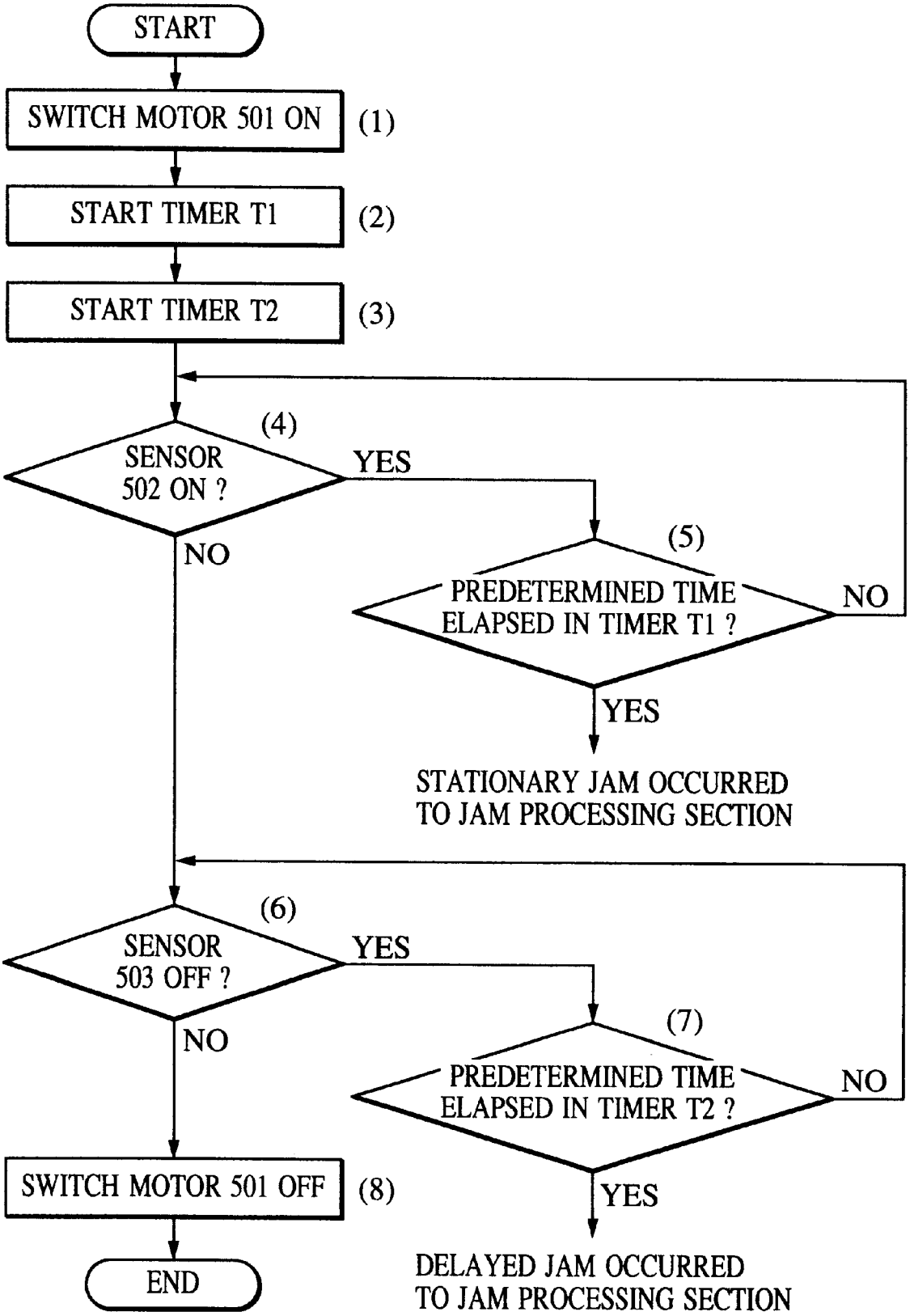
FIG. 7 is a flow chart illustrating an example of a jam-detection processing procedure employed in the copying machine according to the present invention.

FIG. 7 is a flow chart illustrating a representative example of jam-detection processing performed by the copying machine in accordance with the present invention. Reference numerals (1) to (8) in the flow chart indicate computer-executable process steps which comprise the present invention.

In step (1), driving motor 501 is switched on so as to feed a document via RDF 200, for example, and, in steps (2) and (3), jam detection timers T1 and T2 (which are internal timers of the CPU 1900) are started. Then, in steps (4) and (5), it is determined whether the sensor 502 is switched off, i.e., the document has passed through the sensor 502, within a predetermined time specified in the timers T1 and T2. If it is determined in step (5) that a predetermined time has elapsed in the timer T1, the CPU 1900 determines that a stationary jam has occurred and jumps to a jam processing routine.

If it is determined in step (4) that the sensor 502 is switched off, processing proceeds to step (6). In step (6), the sensor 503 is monitored, and it is determined whether the sensor 503 is switched on within a predetermined time and whether the document has been detected. If it is determined in step (6) that sensor 503 is off, and it is determined in step (7) that a predetermined time has elapsed in the timer T2, the CPU 1900 judges that a delayed jam has occurred and jumps to a jam processing routine. Upon completion of paper feeding, processing proceeds to step (8), in which the motor 501 is turned off to end jam detection processing.

FIG. 8 illustrates an example of a jam recording table TB stored in the second RAM 2040 shown in FIG. 3. The table is managed in such a manner that jam information can be updated according to the below-described jam processing routine. FIG. 8 reveals that the jam recording table TB contains a "jam code" comprising the type of jam, a "counter number" comprising the total number of copies which have been made when a jam occurs, and a "time and date" for when the jam occurs.

Figure 9:
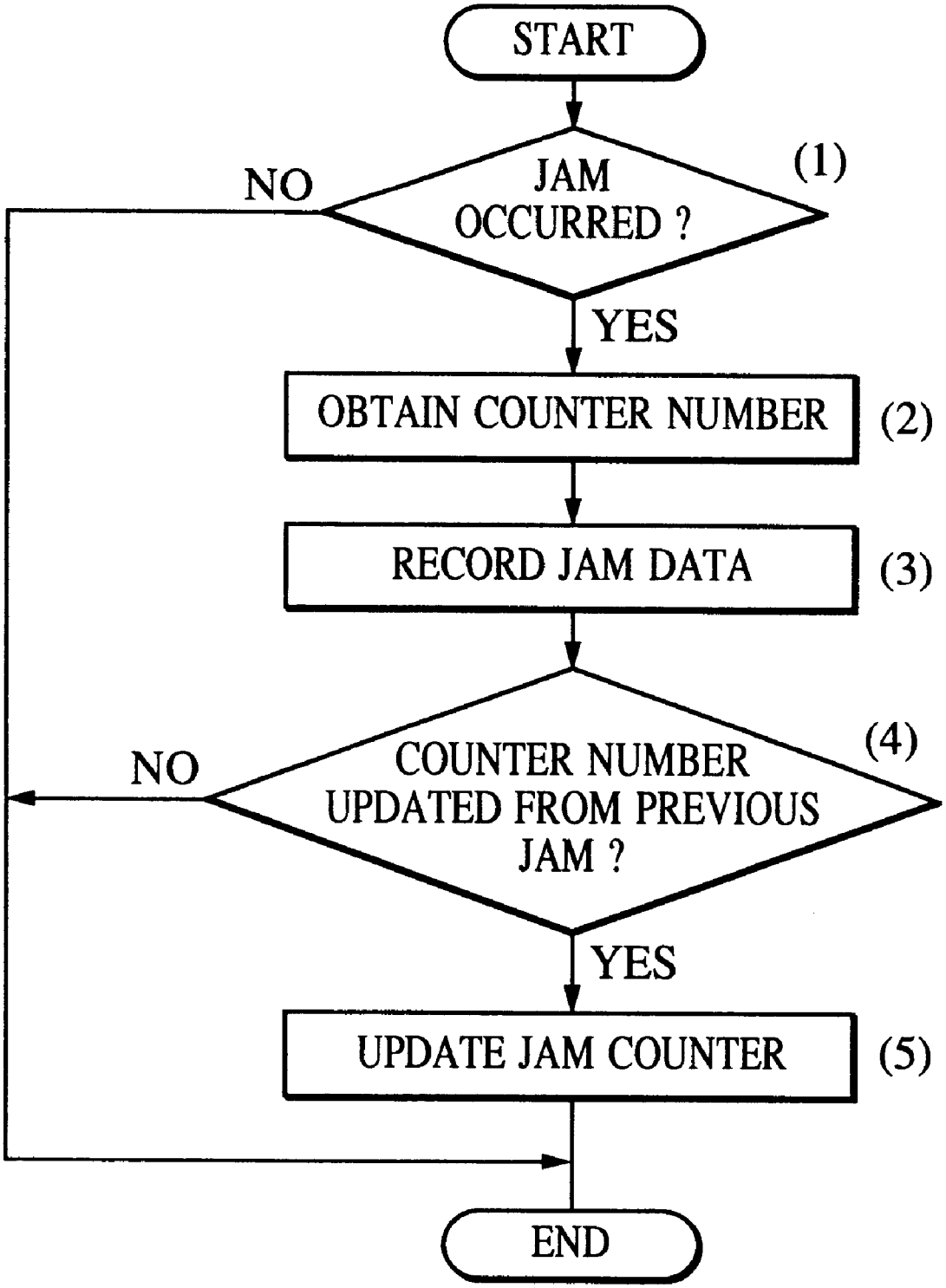
FIG. 9 is a flow chart illustrating an example of a first jam processing procedure used in the copying system according to the present invention.

FIG. 9 is a flow chart illustrating an example of a first jam processing procedure employed in the copying system according to the present invention. In this processing procedure, frequencies of jam occurrences are counted by comparing the number of copies. Reference numerals (1) to (5) in the flow chart comprise computer-executable process steps which are used in the present invention.

Referring to FIG. 9, if it is determined in step (1) that a jam has occurred in the copying machine, the counter number at that time is retrieved in step (2), and is stored in a jam recording table TB, such as the one shown in FIG. 8. Subsequently, the counter number counted when the previous jam occurred is obtained from the jam recording table TB and compared with the present counter number. It is then judged in step (4) whether the counter number has been updated. If the answer is no, the jam in question is ignored. If the answer in step (4) is yes, the jam is determined as a true jam, and the jam counter (the count number of the jam counter, which is the counter of the jam recording table TB, stored in the second RAM 2040) is updated. The communication controller 1970 reports the count number to the host computer 3020 at a predetermined timing or based on an instruction from the host computer 3020. If the discharge sensor 145 detects that a transfer sheet has been discharged without occurrence of a jam, the copy counter increments.

According to the foregoing processing procedure, it is possible to distinguish a true jam from a false jam which can be secondarily generated by an erroneous jam-handling operation by the user. As a result, only true jams can be counted. Alternatively, false jams may be counted separately from true jams. The count number of false jams may be stored according to the type of jam, together with the counter number of copies, in the second RAM 2040, and the jam contents may be reported to the host computer 3020. Alternatively, the host computer 3020 may judge whether a jam in question is true or false, in which case, a history of "jam code", "counter number", and "time and date" contained in the jam recording table TB is transmitted to the host computer 3020 on a regular basis or in response to an instruction from the host computer 3020.

[Second Embodiment]

In the first embodiment, true jams and false jams can be distinguished by determining whether the counter number stored in the jam recording table TB has been updated when a jam occurs. Alternatively, true jams and false jams may be differentiated by comparing the latest time at which the jam stored in the jam recording table TB occurred with the present time. Thus, only true jams may be counted. Such a copying system according to a second embodiment of the present invention is described below.

Figure 10:
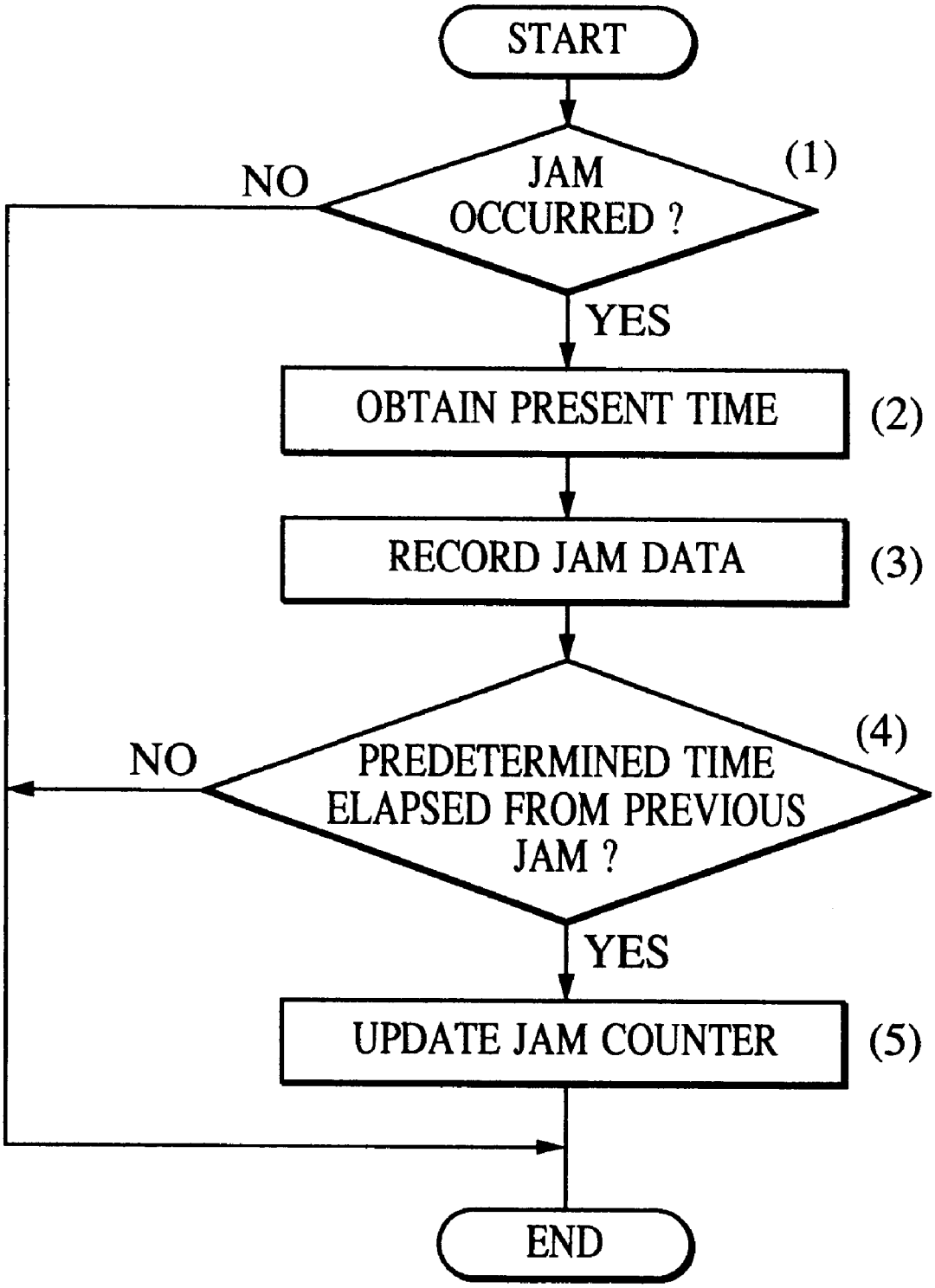
FIG. 10 is a flow chart illustrating an example of a second jam processing procedure employed in the copying system according to the present invention.

FIG. 10 is a flow chart illustrating an example of a jam processing procedure employed in the copying system according to the second embodiment of the present invention. In this processing procedure, the number of jam occurrences is counted by comparing the time at which a jam occurred with the present time. Reference numerals (1) to (5) in the flow chart designate computer-executable process steps which comprise the present invention.

Referring to FIG. 10, in step (1), when a jam occurs in the copying machine, the present time is retrieved in step (2) and stored in the jam recording table TB shown in FIG. 8 in step (3). Subsequently, the time and date at which the previous jam occurred is obtained from the jam recording table TB and compared with the present time. It is then determined in step (4) whether a predetermined time has elapsed. If the answer is no, the jam in question is ignored. If the answer in step (4) is yes, the jam that occurred this time is determined to be a true jam, and the count number of the jam counter (the counter of the jam recording table TB) stored in the second RAM 2040 is updated and registered (5). The communication controller 1970 sends the count number to the host computer 3020 at a predetermined timing or based on an instruction received from the host computer 3020.

The foregoing procedure makes it possible to distinguish a true jam from a false jam which has been generated by an erroneous jam-handling operation by the user. As a consequence, only true jams can be counted. Alternatively, false jams may be counted separately from true jams and stored according to the type of jam, together with the copy counter number, in the second RAM 2040. The jam contents may be reported to the host computer 3020.

Although the foregoing embodiments have been explained through illustration of a jam occurring during document feeding, the present invention may be applicable to other types of jams detectable in the copying machine, such as those occurring during paper feeding, transferring, and discharging in the copying machine body, or jams occurring in extended devices, for example, a sorter unit and a stapler unit, connectable to the copying machine body.

Moreover, the present invention may be applied to a system constructed of a plurality of machines or to a single machine. The present invention can be implemented by supplying a software program comprised of computer-executable process steps to the above-mentioned system or machine. In this case, a recording medium which stores such software for implementing the present invention is read out to the system or the machine, thereby enabling the system or the machine to benefit from the effects of the present invention.

Further, a software program for implementing the present invention may be downloaded from a database on a network and read out to the system or the machine by means of a communication program, thereby enabling the system or the machine to benefit from the effects of the present invention.

Additionally, the jam management data sent to the host computer may be processed by a control program stored in the host computer and may be used for determining whether individual copying machines are broken down. Such data may be employed for other uses as well.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A system for managing recording sheet jams in an image-forming apparatus, comprising:

counting means for counting a number of image formation operations performed by said image-forming apparatus;

jam detection means for detecting a jam in said image-forming apparatus;

storage means for storing (1) the current number counted by said counting means when said jam detection means detects a current jam and (2) a previous number of image operations counted by the counting means during a previous jam; and first determining means for determining whether the current jam is a true jam or a false jam, based on the current number and the previous number.

2. A system according to claim 1, further comprising second determining means for determining, based on a determination made by said first determining means, whether the current number is to be stored in said storage means.

3. A system according to claim 1, wherein said first determining means determines that the current jam is a true jam in a case that the current number does not match the previous number.

4. A system according to claim 1, wherein said storage means stores each number in correspondence with a type of a detected jam.

5. A system for managing recording sheet jam in an image-forming apparatus, comprising:

jam detection means for detecting a jam in said image-forming apparatus;

acquiring means for acquiring a number of image formation operations performed by said image-forming apparatus when the jam is detected by said jam detection means; and determination means for determining whether a current jam is a true jam or a false jam based on the number of image formation operations acquired by the acquiring means for a current jam and a number of image formation operations previously acquired by the acquiring means for a previous jam.

6. A system according to claim 5, further comprising managing means for managing jams so that true jams and false jams are distinguished based on an output result from said determination means.

7. A system according to claim 5, wherein said determination means determines the current jam to be a true jam in a case that the number of image formation operations acquired by the acquiring means does not match the number of image formation operations previously acquired by the acquiring means for the previous jam.

8. A system according to claim 5, further comprising storage means for storing the number of image formation operations acquired by the acquiring means for the current jam in correspondence with a type of the current jam.

9. A system for managing recording sheet jam in an image-forming apparatus, comprising:

jam detection means for detecting a jam in said image-forming apparatus;

storage means for storing a time and a date at which said jam detection means detects a current and previous jams; and first determining means for determining whether the current jam is a true jam or a false jam based on the time and the date at which the current jam is detected stored in said storage means and a time and a date at which a previous jam occurred, stored in said storage means.

10. A system according to claim 9, further comprising second determining means for determining, based on a result output by said first determining means, whether the time and the date that the current jam occurred is to be stored in said storage means.

11. A system according to claim 9, wherein said first determining means determines that the current jam is a true jam in a case that a difference between the time and the date at which the previous jam occurred and the time and date at which the current jam occurred is equal to or greater than a predetermined value.

12. A system according to claim 9, wherein said storage means stores the time and the date at which the current jam occurred in correspondence with a type of the current jam.

13. A system for managing recording sheet jams in an image-forming apparatus, comprising:

jam detection means for detecting a jam in said image-forming apparatus;

acquiring means for acquiring a time and a date at which the jam is detected by said jam detection means; and determination means for determining whether a current jam is a true jam or a false jam based on the time and the date acquired by the acquiring means when a current jam is detected and a time and a date acquired when a previous jam was detected.

14. A system according to claim 13, further comprising managing means for managing jams so that true jams and false jams are distinguished based on an output result from said determination means.

15. A system according to claim 13, wherein said determination means determines the current jam to be a true jam in a case that the difference between the time and the date at which the previous jam was detected and the time and the date at which the current jam was detected is equal to or greater than a predetermined value.

16. A system according to claim 13, further comprising storage means for storing the time and the date acquired for the current jam in correspondence with a type of the current jam.

17. A method for managing recording sheet jams in an image-forming apparatus, comprising the steps of:

detecting a jam in said image-forming apparatus;

storing a number of image formation operations performed by said image-forming apparatus when the jam is detected; and a first determining step of determining whether a current jam is a true jam or a false jam based on a number of image formation operations obtained for a previous jam and a number of image formation operations for the current jam.

18. A method according to claim 17, further comprising a second determining step for determining, based on an output result from the first determining step, whether the number of image formation operations for the current jam is to be stored in the storing step.

19. A method according to claim 17, wherein, in said first determining step, the current jam is determined to be a true jam if the number of image formation operations obtained for the previous jam is not equal to the number of image formation operations for the current jam.

20. A method according to claim 17, wherein, in said first determining step, the number of image formation operations for the current jam is stored in correspondence with a type of the current jam.

21. A method for managing recording sheet jams in an image-forming apparatus, comprising the steps of:

detecting a jam in said image-forming apparatus;

acquiring a number of image formation operations performed by said image-forming apparatus when the jam is detected; and determining whether a current jam is a true jam or a false jam based on the number of image formation operations for the current jam and a number of image formation operations previously obtained when a previous jam was detected.

22. A method according to claim 21, further comprising the step of managing jams so that true jams and false jams are distinguished based on an output result from the determining step.

23. A method according to claim 21, wherein, in said determining step, the current jam is determined to be a true jam in a case that the number of image formation operations obtained for the current jam does not match the number of image formation operations obtained when the previous jam was detected.

24. A method according to claim 21, further comprising the step of storing a number of image formation operations obtained when a jam is detected in correspondence with a type of a detected jam.

* * * * *